United States Patent [19]

Van Ornum

[11] Patent Number: 4,693,001

[45] Date of Patent: Sep. 15, 1987

[54] APPARATUS FOR AIR GAPPING THE ARMATURE IN A COMPOUND SPOOL VALVE

[75] Inventor: Charles A. Van Ornum, Fountain Valley, Calif.

[73] Assignee: McDonnell Douglas Corporation, Long Beach, Calif.

[21] Appl. No.: 901,306

[22] Filed: Aug. 28, 1986

[51] Int. Cl.[4] ..... H01F 41/00

[52] U.S. Cl. ..... 29/759; 29/157.1 R; 29/602 R; 29/756; 29/760

[58] Field of Search ..... 29/756, 759, 760, 602 R, 29/157.1 R; 137/625.65, 625.69

[56] References Cited

U.S. PATENT DOCUMENTS 4,489,483 12/1984 Crowson ..... 29/602 R

*Primary Examiner*—Carl E. Hall

*Attorney, Agent, or Firm*—Paul T. Loef; John P. Scholl; George W. Finch

[57] ABSTRACT

An apparatus for positioning the spool in the valve body and setting the armature air gap with respect to the core assembly of a compound, spool type valve driven electro-mechanically by a pair of face type opposing solenoids.

5 Claims, 4 Drawing Figures

APPARATUS FOR AIR GAPPING THE ARMATURE IN A COMPOUND SPOOL VALVE

BACKGROUND OF THE INVENTION

This invention relates to spool type, electro-pneumatic control valves and more particularly to apparatus to aid in the proper assembly of these valves.

The spool type valve for which this apparatus was directly developed is shown in FIG. 1 and is the subject of patent application Ser. No. 892,303, which is incorporated herein by reference, as though set-out in full. All compound spool type valves have a generally similar arrangement of parts if they are driven electro-mechanically by face type armatures with core assemblies and coils.

Since this valve is a pneumatic valve and is generally applied in missile applications, the leakage at no flow is extremely important and the spool must be properly centered on the sleeve ports when the valve is in the off position. Also, the spool has a total displacement from the neutral or off position of 0.003 to 0.005 inches and since the response time is very critical, exact air gaps between the face type armatures and the core assemblies are critical.

It is an object of this invention to provide a device which locates the spool in relationship to the valve sleeve ports to minimize gas leakage in the off position. It is a further object of this invention to provide means for adjusting the armature on the spool to insure an optimum air gap between the armature and the core assembly, while assuring that the armature face is aligned perpendicular to the spool centerline and parallel to the core surface.

SUMMARY OF THE INVENTION

In summary, the apparatus of this invention accomplishes the above objects by providing a fixture for supporting the valve which is arranged for connecting a gas source to the valve through a suitable gas flow measuring device while interconnecting the first and second cylinder ports of the valve. The apparatus is further equipped with means to displace the spool in the valve body while measuring the gas flow and means to lock the spool in any position. Further, a device is provided which supports the armature on the spool so as to accurately provide the proper air gap between the armature and the core assembly of the solenoid when the valve is assembled. This latter device, of course, must be readily removable as it is a tool to aid the accuracy of assembly.

BRIEF DESCRIPTION OF THE DRAWING

With reference to the drawings, wherein like reference numbers designate like portions of the invention.

DESCRIPTION OF THE PREFERRED EMBODIMENT

Figure 1:
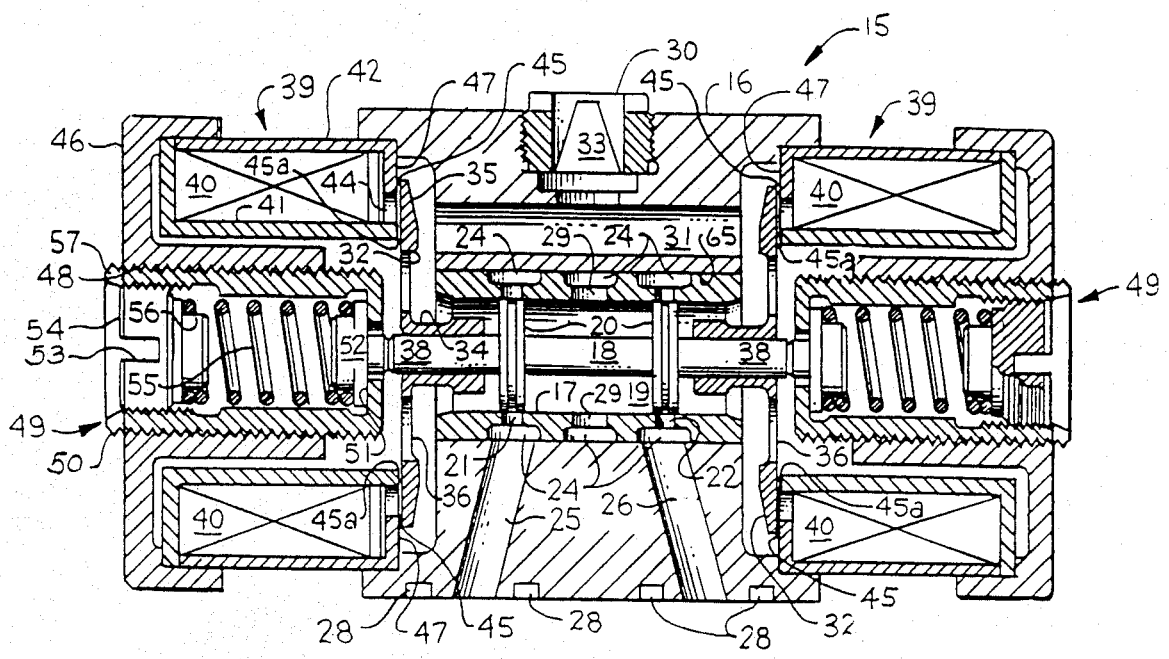
FIG. 1 is an assembly of the valve for which the apparatus was specifically developed.

A compound pneumatic valve 15, of the type for which the apparatus of this invention applies, is shown in FIG. 1, having a valve body 16 which supports a sliding spool 18 in a bore 19 of sleeve 17. Spool 18 has a pair of lands 20 oriented such that when the spool is in the center or closed position the two lands align with or cover the first and second load or cylinder ports 21 and 22. Both ports are shown with an annular relief 24 and first cylinder passage 25 and second cylinder passage 26 which are shown with annular o-ring grooves 28 for bolt on connection to the actuator. The external connections, of course, are a matter of design choice and in some cases it may be preferable to have threaded fittings. The pressure port is shown at 29 also including an annular relief 24 and the passage and external connection are not shown as they are rotated in the plane of the paper. However, pressure enters through the annular relief 24 to the port 29 into the chamber isolated by the bore 19 and the two lands 20. An external vent connection is shown at 30 and contains a dust device 33 which prevents dust from entering the vent connection and in turn connects to the vent bore 31.

Actually ports 21 and 22 are four flow slots equally spaced in the bore 19 of the sleeve 17. Since the spool stroke is only 0.003 to 0.005 inches or about 5% of the width of the slots 21 and 22, the asymmetrical slot allows inlet flow throttling across the smaller right side of the slot and vent flow across the larger left side of the slot. Typically, four such slots are located in the sleeve 17 opposite each of the two spool lands 20.

Connected to both distal ends of the valve spool 18 are face type solenoid armatures 32. The armature 32 consists of a stem portion 34 and a face portion 35 perpendicular to the stem and containing lightening holes 36 to minimize the mass of the armature. The armature 32 is fastened to the spool 18 by a suitable bonding agent, e.g., Locktite TM 609, available from Locktite Corporation, Newington, Conn. 06111. It is recommended that machine operations be selected which provide circumferential or circular striations to both mating surfaces of the spool and armature. The assembly is made so that the distal ends 38 of the spool 18 protrude beyond the face 35 of the armature 32.

The core assembly 39 consists of a helical wire coil 40 clad or jacketed with a magnetic core material which is in two parts, inner jacket 41 and outer jacket 42 with a gap at 44. One end of the core assembly 39 fits into the valve body 16 and is retained by a end cap 46 which is rectangular in cross section and bolts into the valve body to retain the core assembly by corner bolts, not shown. The armature 32 is oriented, in assembly, to the core assembly 39 so that air gaps occur at two places 45 and **45*a*. This arrangement increases the initial pull of the core assembly by establishing a path for the magnetic flux across the core and through the armature via the air gaps 45 and 45*a*. End cap 46 contains a threaded bore 48 on the longitudinal center line which contains an adjustable flow spool centering stop 49**.

The flow spool centering stop 49 consists of a housing 50 which is threaded on the outside to match the threaded bore 48 in the end cap 46. Housing 50 has a through bore with a reduced diameter at one end so as to provide a shoulder 51 and an internal thread at the opposing end. Inside the housing 50 is a tappet 52 which engages shoulder 51 and a spring 55. Finally, a threaded plug 54 with a slot 53 and a shouldered end termination 56, which centers the spring, provides a preload adjustment on the spring 55 and forms a caged spring assembly. The flow spool centering stop 49 is adjustable via slot 57 so as to position the tappet 52 against the distal end 38 of the flow spool stem 18 and further provides an independent adjustment for the preload acting against the tappet 52 by adjusting plug 54. Thus, the flow spool centering stops function to lock the flow spool in the centered position in the absence of valve commands in any type of acceleration environment, provide the spool centering or restoring force in conjunction with the Bernoulli force, to rapidly return the spool to the center position during solenoid drop-out and permit easy final valve adjustment without the need for precise tolerances.

Now, a source of high pressure gas is connected to the pressure port 29 (external connection not shown, but discussed) while first cylinder passage 25 and second cylinder passage 26 are connected to opposing cylinders of a balanced piston actuator. The left solenoid, as pictured, is energized, flow spool 18 moves to the left compressing the spring 55 in the flow centering stop 49. Spool 18 displacement allows the high pressure gas to flow to cylinder 1 while at the same time the gas from the second cylinder flows out second cylinder port 22 and through the vent 31 to the external vent 30. The exhaust gases, of course, cool the core assembly 39. When the solenoid is de-energized, the left and right adjustable flow spool centering stops 49 again center the flow spool, cover the flow ports 21 and 22 to shut off the flow of the gas. Since the total spool 18 displacement in either direction is 0.003 to 0.005 inches, the initial preloaded centering force provided by the spring 55 remains essentially constant.

Since the stroke of the spool 18 from the neutral or off position to full movement in one direction is only 0.003 to 0.005 inches, setting the air gap 45 between the armature 32 and the core assembly 39 is critical. It must be maintained within a few ten-thousandths of an inch while at the same time limiting the runout between the armature 32 and the core surface to a few ten-thousandths of an inch. These critical dimensions are maintained by counter-boring the diameter C in FIG. 2 on the same setup used to produce the spool sleeve bore 65 so as to maintain the shoulder surface A in the valve body (FIG. 2) on which the core assembly surface 47 bottoms perpendicular to spool motion.

Figure 2:
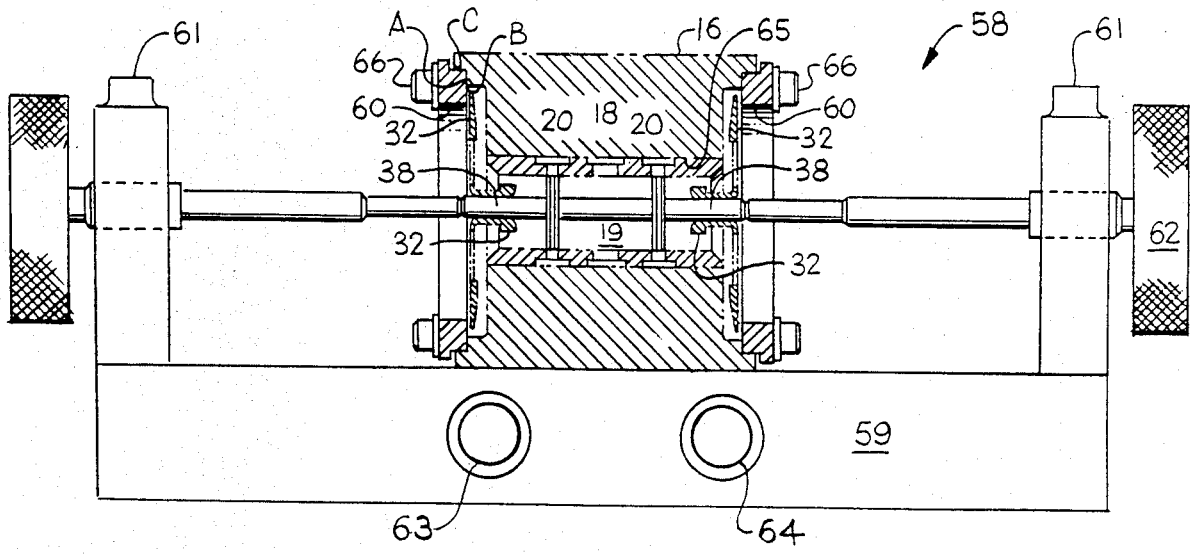
FIG. 2 is a view of the apparatus of the invention with the outside line of the valve being assembled shown in reference lines.
Figure 3:
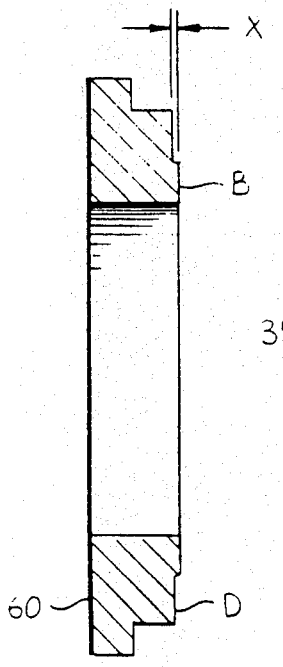
FIG. 3 is a view of the device for setting the armature air gap.
Figure 4:
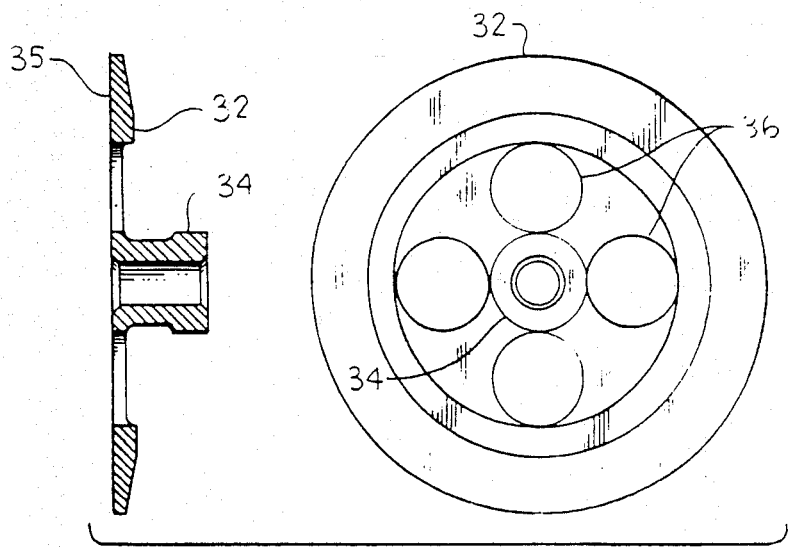
FIG. 4 is two views of the armature.

The adjustment apparatus, shown in FIG. 2, is used to lock the spool in its centered position, based on flow measurements. That is, after attaching the valve body 16 to the fixture base, the spool 18 is inserted in the bore 19 after the spool lands 20 have been trimmed to exactly match the ports 21 and 22 in the valve body (FIG. 1). The armatures 32 are slipped on the ends 38 of the spool 18 along with the magnetic adapters 60. A low pressure gas source is then hooked up through a flow meter to the pressure port 29 of the valve body 16 and the spool 18 is positioned by the micrometer adjusters 61 by turning the thumbscrews 62 until the inlet gas flow is a minimum with a shunt connected between ports 63 and 64 which are in turn connected to cylinder passageways 25 and 26, respectively, (FIG. 1). This represents the neutral or off position of the valve, and the valve spool is locked in this position by the micrometer adjusters 61. Magnetic adapter plate 60 is then bolted to the valve body 16 with the fasteners 66 and, since it is magnetic, it holds the armature 32 against the surface B of the adapter 60. Since the dimension X (FIG. 3) is closely held to the proper tolerance on the adapter, it automatically presets the air gap as the adapter 60 surface D represents the core assembly 39. When the armatures 32 are indexed to the spool 18, a drop of Locktite 609 or equivalent is placed at the intersection of distal end 38 of the spool 18 and the inside diameter of the armature 32 and allowed to "wick" into the joint. The assembly in the jig is then heated to 150° F. for two hours to cure the bonding agent. The armatures are now indexed to the flow spool with the solenoid stroke accurately set to the X dimension as shown on the adapter 60.

The apparatus of this invention has been specifically developed for use with the compound valve shown. However, all compound spool type control valves using face type armatures are generally similar and the apparatus would be beneficial. It is to be understood that the shown embodiment is merely illustrative of and not restrictive on, the broad invention. It is not intended to limit the invention to these specific arrangements, constructions or structures described, for various modifications thereof may be accomplished by persons having ordinary skill in the art.

What is claimed is:

1. An apparatus for positioning the spool in the valve body bore and setting the armature air gap with respect to the core assembly of a solenoid of a compound, spool type valve having a pressure inlet port and first and second cylinder ports, comprising:

means for supporting said valve body having first means for connecting a gas source with gas flow measuring means to said valve pressure inlet port and second means for interconnecting said valve first and second cylinder ports with a shunt;

means for displacing and locking said valve spool in said valve body while measuring gas flow at said flow measuring means when said first means is connected to a gas source; and means for supporting said armature in spaced relationship to said valve body while slipped over said spool so as to set the air gap between said armature and said core assembly of said solenoid.

2. The apparatus of claim 1 wherein said means for displacing and locking said valve spool in said valve body are micrometer adjusters aligned to abut the opposing ends of said spool.

3. The apparatus of claim 1 wherein said means for supporting said valve body includes means for measuring the combined gas flow from said valve first and second cylinder ports.

4. The apparatus of claim 1 wherein said means for supporting said armature comprises a magnetically charged adapter which registers on a surface perpendicular to said valve body bore which is also the seating surface for said core assembly and said adapter has a stepped surface which supports said magnetic armature and said step is exactly equal to the desired stroke of said armature whereby said adapter is readily removable after attaching said armature to said spool.

5. An apparatus for positioning the spool in the valve body bore and setting the armature air gap with respect to the core assembly of a compound, spool type valve having a pressure inlet port and first and second cylinder ports, comprising:

means for supporting said valve body having first means for connecting a gas source with gas flow measuring means to said valve inlet pressure port and second means for interconnecting said valve first and second cylinder ports with a shunt;

micrometer adjusters driven by thumb screws, aligned with each end of said valve spool so that said spool may be adjustably displaced in either direction and locked in place responsive to the gas flow at said first and second cylinder ports to determine the best neutral or off positions of said valve;

an adapter which registers on a surface perpendicular to said valve body bore which is also the seating surface for said core assembly and said adapter has a stepped surface which supports said armature, and said step is exactly equal to the desired stroke of said armature; and means to attach said armature to said adapter which are readily removable after said armature is permanently attached to said spool.

* * * * *